United States Patent [19]

Duenke

[11] 4,401,963

[45] Aug. 30, 1983

[54] RESISTOR INSERTION FUSE

[75] Inventor: Clarence G. Duenke, Marthasville, Mo.

[73] Assignee: Warco, Inc., Marthasville, Mo.

[21] Appl. No.: 330,251

[22] Filed: Dec. 14, 1981

[51] Int. Cl.[3] ..... H01H 85/42

[52] U.S. Cl. ..... 337/282; 337/159; 361/39; 361/41; 361/104

[58] Field of Search ..... 361/41, 39, 104; 337/282, 278, 279, 224, 158, 159

[56] References Cited

U.S. PATENT DOCUMENTS

| | | | |
|---|---|---|---|
| 1,270,272 | 6/1918 | Downes et al. . | |
| 2,134,470 | 10/1938 | Conrad . | |
| 2,567,768 | 9/1951 | Fahnoe . | |
| 2,660,644 | 11/1953 | Murray et al. | 337/224 |
| 3,188,432 | 6/1965 | Bronikowski . | |
| 3,255,383 | 6/1966 | Astleford, Jr. | 361/39 |
| 3,684,995 | 8/1972 | Horton | 337/224 |
| 3,827,011 | 7/1974 | Braunstein | 337/282 X |
| 3,916,260 | 10/1975 | Westrom et al. . | |
| 3,958,206 | 5/1976 | Klint . | |
| 4,002,949 | 1/1977 | Westrom . | |

*Primary Examiner*—Reinhard J. Eisenzopf

*Attorney, Agent, or Firm*—Hubbard, Thurman, Turner & Tucker

[57] ABSTRACT

A protective fuse comprising a fusible element disposed within an enclosure formed by a gas generating fiber tube connected at one end to a conductor rod and at the other end to an arc intercepting member. The arc intercepting member is connected to an elongated tubular resistor element which in turn is connected at its opposite end to a cap comprising a conductor connected to the fusible element. Upon parting of the fusible element an arc established by the fault current comes into contact with the arc intercepting member so that a circuit is established through the resistor element thereby momentarily reducing the fault current to a level which can be extinguished by the deionizing gases generated within the interior of the fuse. The conductor rod is formed of a magnetic material which is capable of generating a substantial magnetic flux which functions to bias the arc against the interior wall of the fiber tube to enhance the generation of deionizing gases. The resistor element is soldered to the arc intercepting member and the conductor cap with solders having different melting points whereby the cap may be blown off the resistor to lengthen the distance between conductor elements.

15 Claims, 2 Drawing Figures

RESISTOR INSERTION FUSE

BACKGROUND OF THE INVENTION

1. Field of the Invention

The present invention pertains to a fuse for insertion in the primary circuit of a high voltage transformer or other device and having a rupturable element wire which melts at a predetermined current level. The fuse includes an arc intercepting element and a resistor in circuit with the intercepting element to reduce fault currents momentarily to an arc extinguishing level to clear the circuit.

2. Background Art

In the art of protective fuses for electrical circuits and the like, and in particular for high voltage transformer circuits, it is known to provide so-called protective links to remove an internally faulted transformer from the primary line thereby preventing outages to other circuits on the line not served by the faulted transformer. The conventional approach to providing circuit clearing fuses for faulted transformers and other high voltage circuits has included the provision of a fuse having a component which melts or decomposes to produce an arc extinguishing gas to eliminate continued arcing. However, the conventional silver/sand current limiting fuses are expensive and it has been impractical to equip distribution transformers with this type of fuse. At the same time, there has been an increasing number of systems wherein potential fault currents are much higher than previous fuse designs are capable of interrupting without some danger to equipment and to the environment surrounding the transformer itself.

It has been determined that conventional weak link type current limiting fuses which, for example, operate by utilizing gas pressure to propel one end of the fuse structure away from the other end in an oil filled transformer to provide circuit interruption, have been found to be suitable for fault currents in the range of 1500 amps or less. For higher fault currents it has become necessary to strengthen the mechanical structure of the fuse, as well as the support bushing for the fuse. This has become increasingly expensive and a not entirely satisfactory solution to failures wherein fault currents in the range of 3,000 to 35,000 amps may occur.

Accordingly, since the conventional rupturable element type fuse, provided with a material such as a vulcanized fiber tube surrounding the fuse element to provide the arc extinguishing gas, has been relatively successful for current levels in the range of 100 to 1500 amps, it has been determined that it is desirable to provide for a fuse structure which will insert a resistor in the circuit on failure of either the transformer or any other circuit which might occur within the transformer enclosure. The object of the present invention is to provide for directing the arc established upon melting of the fuse element in such a way that it passes through a resistor to at least momentarily reduce the current level to a value which will result in extinguishment of the arc in the presence of a deionizing gas. This functional advantage is provided by structure which has heretofore not been provided in the art of protective link fuses for transformers and the like. Moreover, the particular arrangement of a protective fuse in accordance with the present invention also provides, in one compact structural unit, the capability of protecting the circuit against short circuit conditions when the current is at a relatively low level and upon heating of the resistor whereby sufficient mechanical separation of the fuse conductor elements may be obtained to prevent arc establishment or restrike.

SUMMARY OF THE INVENTION

The present invention provides an improved protective link or circuit interrupting fuse for relatively high voltage applications, particularly in the environment of protecting the primary circuit of a distribution transformer or the like, wherein an improved arrangement of a resistor element is provided to momentarily reduce the fault current to a level which will provide arc extinguishment by deionizing gases generated by failure of the fuse.

In accordance with one aspect of the present invention, there is provided a fuse element for a transformer or the like which includes a fusible link, which upon melting as a result of an overload current, establishes an arc or sufficient energy to decompose a gas generating substance. The fuse is also provided with an arc intercepting element which is in circuit with a resistor which momentarily reduces the fault current to a level which will enable the deionizing gas to extinguish the arc and to prevent restrike.

In accordance with another aspect of the present invention, there is provided an improved fuse structure including a fusible element, an arc intercepting element, and a resistor arranged in such a manner that heating of the resistor will cause mechanical separation of one terminal of the fuse with sufficient force to separate the fuse conductor elements to interrupt or extinguish an arc. The fuse is preferably disposed in an arc suppressing environment such as by being at least partially immersed in transformer insulating fluid.

In accordance with yet another important aspect of the present invention, there is provided a fuse of a type which is adapted to be inserted in an insulating bushing which includes a main current carrying member made of a suitable magnetic material which produces a magnetic field of sufficient strength to control the location of an electrical arc. The magnetic field produced by the current carrying member forces the arc into the vicinity of a gas generating fiber tube to produce a greater amount of arc extinguishing gas more rapidly than with prior art protective link type fuses.

The present invention still further provides an improved fuse construction for use in connection with transformers and other high voltage devices wherein the fuse is adapted to be immersed in oil and includes an orifice which allows the interior of the fuse structure to fill with oil when immersed but is also sized to control the generation of gas pressure upon failure of the fuse so that a pressure force will cause certain elements of the fuse to forcibly separate from the remainder of the fuse structure for greater separation of the conductor elements to provide arc extinguishment.

The overall construction of the protective link type fuse of the present invention is compact, economical to manufacture and superior to fuses heretofore known in the art. Those skilled in the art will appreciate the advantages discussed herein, as well as other superior features of the present invention which will become apparent upon reading the detailed description which follows in conjunction with the drawing.

DESCRIPTION OF THE PREFERRED EMBODIMENT

The present invention comprises an expulsion type fuse of the type to be used in electrical distribution transformers and the like and which is adapted to be placed in series with the high voltage winding of the transformer to clear the circuit by generating an arc extinguishing gas to interrupt the fault current as the current approaches a zero point on its wave form. In particular, the fuse of the present invention is adapted to provide arc interruption and circuit clearing without the necessity of increasing the mechanical strength of associated structure such as, for example, the transformer bushing and tank.

Figure 1:
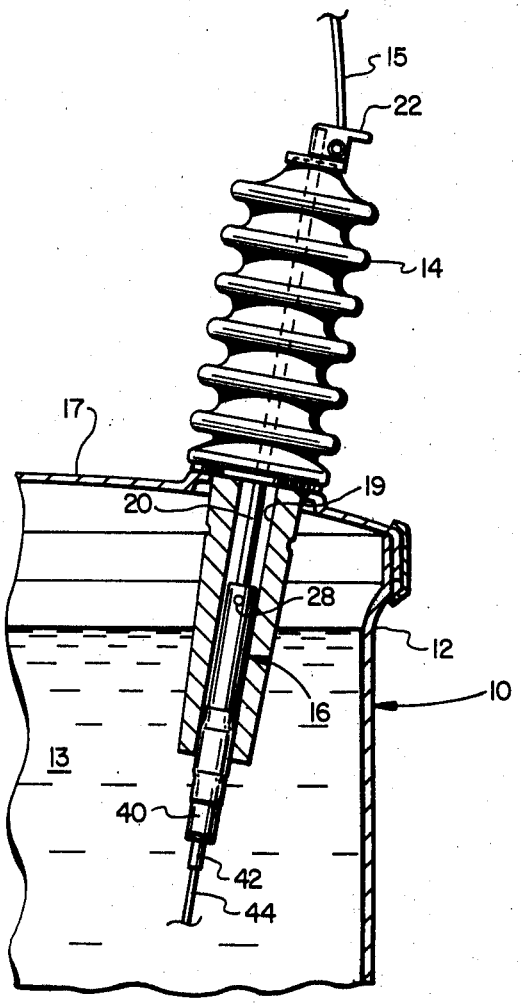
FIG. 1 is a partial elevation in section of a typical electrical distribution transformer showing the fuse of the present invention mounted in an insulating bushing.

Referring to FIG. 1 of the drawings, there is shown a portion of a typical electric utility distribution transformer generally designated by the numeral 10. The transformer 10 includes a tank 12 in which the transformer windings are disposed and covered with an insulating and cooling oil 13 with which the tank interior is filled. A high voltage conductor 15 is connected to the transformer at a porcelain bushing of a conventional type, designated by the numeral 14, which is mounted on a top wall or cover portion 17 of the tank and extends into the interior of the tank, as illustrated. The bushing 14 is provided with an internal bore 19 in which is mounted a fuse or protective link in accordance with the present invention and generally designated by the numeral 16. A lower portion of the fuse 16 extends from the bottom end of the bushing and the fuse is substantially immersed in the transformer oil contained within the tank. Although the fuse 16 is illustrated as being mounted within the high voltage bushing 14, it will be understood that the fuse may be mounted on a terminal block within the transformer tank or on other suitable structure within or even outside the tank. Moreover, the fuse 16 will also operate satisfactorily in the presence of air or other gaseous insulating fluids as well as liquid insulating fluids including the oil 13.

Referring further to FIG. 1, the fuse 16 includes an elongated conductor element or rod 20 which extends through the top of the bushing 14 and is suitably connected to a connector element 22 which in turn is connected to the high voltage conductor 15.

Figure 2:
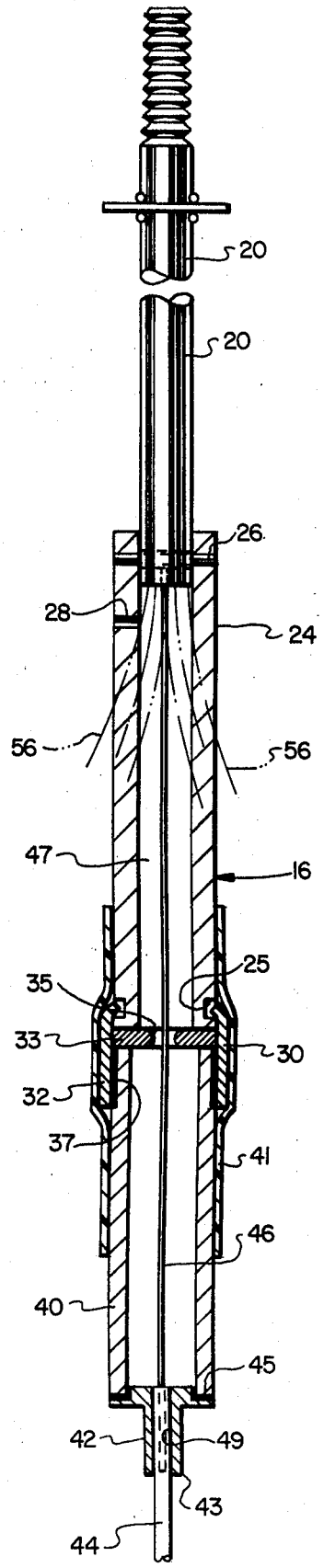
FIG. 2 is a longitudinal central section view of the fuse of the present invention.

Referring now to FIG. 2, in particular, the fuse 16, including the conductor rod 20, is shown in longitudinal elevation with a major portion of the fuse shown in longitudinal central section. The lower end of the conductor rod 20 is fastened to an elongated tubular element 24 comprising a vulcanized fiber tube of a type which is adapted to generate a deionizing gas when exposed to a high voltage electrical arc or other heat generating phenomena which would tend to decompose the tube. The tube 24 is of a type commercially available for use in transformer fuses and the like. The tube 24 is snuggly fitted over the end of the rod 20 and is secured to the rod by a transverse pin 26 which extends through the rod and through a suitable diametral hole drilled through opposed portions of the sidewall of the tube 24. Directly below the rod 20 is a vent hole 28 which is drilled through the sidewall of the tube 24 to provide for controlled venting of gases from the interior of the tube and to permit the interior of the fuse to fill with insulating fluid such as transformer oil.

The lower end of the tube 24 is provided with a circumferential groove 25 which is engaged by a copper or steel tubular sleeve 30 suitably crimped into the groove as illustrated. Alternatively, the tube 24 could be provided with tapered threads engageable with cooperating threads formed on the sleeve member 30. The sleeve 30 is disposed around and contiguous with an arc intercepting member characterized by a cylindrical plate 33 having a cylindrical opening formed in the center thereof and which is delimited by a convex curved wall portion 35. The rounded surface or wall portion 35 is provided to reduce the effects of dielectric stress exerted on the member 33 when the member acts to intercept an electrical arc, as will be discussed in further detail hereinbelow. The member 33 may be formed of a suitable metal conductor material such as brass. Alternatively, the members 30 and 33 could be fabricated as a single piece.

The fuse 16 is still further characterized by a cylindrical tubular resistor element generally designated by the numeral 40 which is fitted within the interior of a depending portion 32 of the sleeve member 30 and is connected at its opposite end to a cap 42. The resistor element 40 may be of varied construction such as, for example, a resistive material with wound wire or, preferably, a high temperature material such as silicon carbide. In a preferred embodiment of the present invention, the resistor element 40 is of a type commercially available from the Carborundum Company, Niagara Falls, N.Y. as their type SP high power non-inductive resistors. The resistor element 40, for a particular fuse element having the capability of interrupting fault currents in the range of 100 amps to 3500 amps or more, has a nominal resistance of 7.5 ohms and is a type 885 SP 7R5L, the designation being that of the abovementioned source of this element. The resistor element 40 is secured to the member 30 at an interface 37 within the portion 32 by a relatively high temperature solder such as a conventional lead-tin solder having a 40/60 or 50/50 composition of lead with respect to tin of which the eutectic point is in the range of 456° F. The element 40 and member 30 could be provided with other means such as cooperating threads for securing these parts to each other. The fuse 16 is also preferably provided with a sleeve member 41 comprising a heat shrinkable fluorocarbon plastic tube disposed over the sleeve member 30 and extending longitudinally beyond each end of the sleeve member 30. The sleeve 41 forms a substantially gas tight seal and supports the assembled components of the fuse 16.

The lower end of the resistor element 40 is soldered to the cap 42 which also may be made of brass, for example. The resistor element 40 is secured to the cap 42 by a solder layer 45 having a lower melting point than the solder used to secure the upper end of the resistor element to the member 30. For example, a solder comprising 43% tin, 14% bismuth and 43% lead with a melting point in the range of 289° to 325° F. is preferably used. The use of the lower melting point solder layer 45 to form the connection between the cap 42 and the resistor element 40 provides for forcible separation of the cap from the remainder of the fuse due to melting of the solder upon heating of the resistor and generation of gas pressure within the interior of the fuse upon failure of the fuse element itself. In this way, a conductor 44 connected to the cap 42 and leading to the primary windings of the transformer, not shown, may be blown clear of the fuse into the interior of the tank to reduce the possibility of arc strike or restrike in the event of relatively slow failure of the fuse.

The fuse 16 is yet further characterized by an elongated fuse element 46 comprised of fuse element wire commonly used in distribution transformer fuses and properly sized to provide for rupture such as by melting of the wire on experiencing a fault current greater than a nominal 5 to 10 times the normal full load current in order to remove the transformer from the system circuit. The fuse element wire itself forms no part of the present invention and may be made of conventional fusible element materials used in distribution transformer fuses. The element 46 may be formed of silicon bronze and be a no. 25 to a no. 12 round AWG size wire, for example. The fuse element 46 is inserted in a hole formed in the lower end of the conductor rod 20 and a fixed thereto by brazing, for example. The opposite end of the fuse element 46 is secured to the stranded conductor 44 within the central bore 49 formed in the cap 42 by crimping the sleeve portion 43 of the cap to retain the conductor and fuse element 46 in assembly with the cap. The fuse 16 can also be provided with an elongated thin walled plastic tube or sheath, not shown, disposed around the fuse element 46 and spaced somewhat therefrom but within the bore formed by the tube 24 and the resistor element 40. Such a tube is adapted to surround the fuse element to confine low current arcing within the tube upon rupture of the fuse element 46 but which would burst on relatively high fault currents.

By providing the arc intercepting member 33 and also the resistor element 40 as part of the fuse structure, the improved fuse 16 of the present invention is operable to direct the electrical arc generated upon melting of the fuse element 46 in such a way that the fault current passes through the resistor element 40 and is momentarily reduced sufficiently to allow the gases generated within a chamber 47 formed by the bores of the resistor 40 and the tube 24 to extinguish the arc and prevent arc restrike after the current passes through the zero point on its wave form. The combination of the system grounding impedance and the resistive impedance of the resistor element 40 is sufficient to reduce fault currents in the 3,000 to 35,000 amp range and higher to values which have been successfully interrupted using the technique of arc extinguishment by the generation of a deionizing gas in the vicinity of the arc. The resistor element 40 is not a primary conductor element of the circuit except on separation of the fuse element 46 and establishment of an arc which is intercepted by the member 33. However, the resistor element 40 is inserted in the circuit as rapidly as the creation of the arc.

In accordance with another important aspect of the present invention, by providing the elongated conductor rod 20 of a soft annealed steel such as, for example, SAE 1019 low carbon steel, the rod is capable of generating a magnetic field 56 having a flux sufficient to direct an arc generated upon rupture or melting of the fuse element 46 in such a way that the arc remains in proximity to the interior of the fiber tube 24. By forcing the arc against the interior of the fiber tube, greater amounts of deionizing gas are quickly generated than would occur if the arc location were not controlled. At the same time, the arc is also, of course, directed into contact with the intercepting member 33 whereby the fault current passes through the resistor element 40 to momentarily reduce the current value as described above.

Another important aspect of the structure and function of the present invention pertains to the arrangement whereby the interior chamber 47 formed by the bores of the tube 24 and the resistor element 40 is substantially sealed except for the vent hole 28. The fit between the conductor rod 20 and the fiber tube 24 is substantially fluid tight as is the fit between the tube 41 and the members 24 and 40. The conductor 44, which is preferably of stranded wire, presents substantial resistance to rapid fluid flow through the bore 49 but has sufficient porosity to allow oil to enter the interior of the fuse. Accordingly, gas generated within the chamber 47 upon failure of the fuse element 46, is substantially confined to the interior of the fuse with some controlled venting through the vent hole 28. The vent hole 28 also allows the interior of the fuse to fill with oil or other fluid from the transformer tank when immersed therein, as illustrated.

Under certain operating conditions, upon failure of the fuse element 46 and shunting of the fault current through the resistor element 40, the resistor element will be heated sufficiently to melt the solder 45 joining the cap 42 to the resistor element. Accordingly, the pressure generated by the formation of the deionizing gas within the interior of the resistor would forcibly eject the cap 42 from the end of the resistor element into the transformer tank a sufficient distance to prevent sustainment of an arc.

Accordingly, the fuse 16 provides multiple arc extinguishment features comprising the shunt resistor 40 and the provision of an expulsion cap 42 which operates to physically separate the conductor 44 from proximity to the conductor rod 20 a sufficient distance to prevent sustainment of the fault current arc. Moreover, the fuse 16 is arranged within the support bushing 14 such that the resistor element 40 extends from the lower end of the bushing. Accordingly, in situations where a fault current arc may be occurring within the interior of the transformer tank enclosure as caused by either over voltage, lightning strike or insulation degradation, the arc can then move into contact with the resistor element whereby the circuit is established through the resistor element 40 to reduce the arc current sufficiently to effect extinguishment of the arc.

As indicated hereinabove, the materials of construction of the fuse 16 are of some importance, including the material used for the conductor rod 20. The rod 20 is preferably formed of cold rolled soft steel which has been annealed and plated with a suitable corrosion resistant plating or coating. The tube 24 is of a type which is known for use in connection with fuses for distribution transformers and the like and is formed of an organic fiber which generates a substantial amount of deionizing gas to counteract the generation of ionized gas produced by the arc in the presence of the transformer oil or other insulating fluid. The provision of the arc intercepting member 33 of soft steel or copper alloy with the curved surface 35 reduces the dielectric stress concentration in this element. The resistor element 40 may take various forms although the type of element described herein is preferable in that it provides a compact and suitable structural arrangement for the fuse itself. The particular commercial element described herein is provided with metallized ends to facilitate fixing the resistor element to the sleeve member 30 and to the cap 42 by soldering, as described.

Those skilled in the art of high voltage protective devices will appreciate from the foregoing that a superior protective link has been provided by the present invention which is economical to manufacture, and is reliable in operation. The fuse 16 includes a number of superior features which function in combination to provide for circuit clearing in high voltage and high amperage short circuit conditions such as are experienced in a number of electrical devices and, in particular, in electrical distribution system transformers. Those skilled in the art will also appreciate that various substitutions and modifications may be made to the present invention without departing from the scope of the appended claims.

What I claim is:

1. A fuse for use in a relatively high voltage circuit comprising:

a first conductor element comprising a terminal at one end of said fuse;

a second conductor element comprising a terminal at the opposite end of said fuse;

an elongated rupturable fuse element interconnecting said first and second conductor elements;

a gas generating member disposed around at least a portion of said fuse element;

an arc intercepting member disposed around said fuse element between said conductor elements; and a resistor element connected to said intercepting member in electrically conductive relationship thereto for reducing the value of an arc generating fault current sufficiently, upon rupture of said fuse element, so that said arc is extinguishable by deionizing gas generated by said gas generating member.

2. The fuse set forth in claim 1 wherein:

said fuse includes a tubular member connected to said intercepting member and disposed around said fuse element, said tubular member extending over substantially the remaining portion of said link element.

3. The fuse set forth in claim 2 wherein:

said tubular member is connected at its opposite end to a cap closing one end of a chamber formed by said gas generating member and said tubular member.

4. The fuse set forth in claim 1 or 3 wherein:

said intercepting member includes a cylindrical plate portion having a central opening therein through which said fuse element extends from said first conductor element to said second conductor element.

5. The fuse set forth in claim 4 wherein:

said cylindrical plate includes a curved wall portion defining said opening.

6. The fuse set forth in claim 3 wherein:

said tubular member includes said resistor element.

7. The fuse set forth in claim 6 wherein:

said tubular member is fixed to said cap by a solder which is meltable at a predetermined temperature to permit said cap to be blown off of said tubular member by the pressure of gas generated within said chamber and upon heating of said resistor element.

8. The fuse set forth in claim 7 wherein:

said intercepting member includes a sleeve portion fixed to said tubular member at the end of said tubular member opposite said cap.

9. The fuse set forth in claim 8 wherein:

said sleeve portion is fixed to said tubular member by a solder, said solder having a melting temperature greater than the solder fixing said tubular member to said cap.

10. The fuse set forth in claim 7 or 9 wherein:

said resistor element comprises a silicon carbide sleeve comprising said tubular member.

11. The fuse set forth in claim 7 wherein:

said fuse includes a vent orifice opening from the exterior of said fuse into said chamber.

12. The fuse set forth in claim 1 wherein:

said first conductor element comprises an elongated rod fixed to one end of said gas generating member.

13. The fuse set forth in claim 12 wherein:

said rod is made of annealed steel capable of generating a magnetic field of sufficient intensity to force an arc generated by said fault current into contact with said gas generating member.

14. The fuse set forth in claim 1 wherein:

said intercepting member includes a sleeve portion connected to one end of said gas generating member.

15. The fuse set forth in claim 14 together with:

an insulating sleeve disposed around said intercepting member and secured to said gas generating member.

* * * * *

UNITED STATES PATENT AND TRADEMARK OFFICE

CERTIFICATE OF CORRECTION

PATENT NO. : 4,401,963

DATED : August 30, 1983

INVENTOR(S) : Clarence G. Duenke

It is certified that error appears in the above-identified patent and that said Letters Patent is hereby corrected as shown below:

Column 1, line 54, after "other" insert --short--.

Signed and Sealed this

*Nineteenth* Day of *February 1985*

[SEAL]

*Attest:*

DONALD J. QUIGG

*Attesting Officer*

*Acting Commissioner of Patents and Trademarks*